US005231934A

United States Patent [19]

Good

[11] Patent Number: 5,231,934

[45] Date of Patent: Aug. 3, 1993

[54] CONVERTIBLE SKID WITH MULTIFUNCTIONAL LEG STRUCTURE

[76] Inventor: Bruce R. Good, 54 Tanya Ct., Plantsville, Conn. 06479

[21] Appl. No.: 883,109

[22] Filed: May 14, 1992

[51] Int. Cl.[5] ..... B65D 19/38

[52] U.S. Cl. ..... 108/54.1; 108/51.1

[58] Field of Search ..... 108/51.1, 54.1, 56.1, 108/53.1

[56] References Cited

U.S. PATENT DOCUMENTS 4,890,560 1/1990 Good ..... 108/53.1

FOREIGN PATENT DOCUMENTS 0711810 7/1954 United Kingdom ..... 108/51.1

8102148 8/1981 World Int. Prop. O. ..... 108/51.1

*Primary Examiner*—Kenneth J. Dorner

*Assistant Examiner*—Gerald A. Anderson

*Attorney, Agent, or Firm*—Ira S. Dorman

[57] ABSTRACT

A circular skid is convertible to provide a square supporting surface by extending hingedly mounted triangular panels from closed, inwardly directed positions to open, outwardly directly ones. The skid utilizes leg structure that consists of an assemblage of three tubular pieces fixed in side-by-side, coplanar relationship to one another.

12 Claims, 7 Drawing Sheets

CONVERTIBLE SKID WITH MULTIFUNCTIONAL LEG STRUCTURE

BACKGROUND OF THE INVENTION

U.S. Pat. No. 4,890,560, which issued to the present inventor on Jan. 2, 1990, discloses and claims a circular skid that is adapted for transport from place-to-place by rolling on edge, and for stacking one upon another. Although entirely satisfactory for its intended purposes, modifications have been found to be desirable.

In particular, a skid that provides a circular surface is adapted for carrying coils of product, but is not particularly well suited for the transport of cubic loads. In addition, the supporting legs shown in the above-identified patent are not optimal from a number of standpoints.

SUMMARY OF THE INVENTION

Accordingly, it is a broad object of the present invention to provide a novel skid that is convertible to present alternatively generally circular and generally square supporting surfaces.

A more specific object of the invention is to provide such a skid which retains the capability for rolling transport and stacking exhibited by the skid of the aforementioned patent.

Another broad object of the invention is to provide a novel skid that has leg members which contribute to overall strength and adapt the skid for transport on a conventional roller conveyor, as well as affording other advantageous features.

A general object of the invention is to provide an improved skid having all of the features and advantages provided by the skid of the above-mentioned patent.

It has now been found that certain of the foregoing and related objects of the invention are attained by the provision of a convertible skid, adapted for providing alternatively generally circular and generally square supporting surfaces, comprising a circular member having circumferential edge structure disposed outermost thereon in a first configuration; a plurality of leg members attached to the lower portion of the circular member and extending downwardly therefrom at spaced locations thereabout, for supporting the skid on a flat surface; and a multiplicity of extension members attached to the upper portion of the circular member for movement between retracted and extended positions relative thereto. The extension members lie substantially entirely within the boundary of the edge structure of the circular member in their retracted positions, thereby cooperatively presenting a circular supporting surface in the first configuration of the skid. They lie substantially outwardly of the boundary in their extended positions, cooperatively presenting an effectively square supporting surface in the second skid configuration.

Other objects of the invention are attained in a skid that comprises support means, providing a load-supporting surface, including a multiplicity of elongate arm members extending generally radially with reference to a common center, and a plurality of leg members operatively joined to the arm members and extending downwardly therefrom at spaced locations about the support means. Each leg member includes an elongate foot assembly comprised of three tubular pieces laterally joined to one another in parallel, generally co-planar assemblage, and a pair of mutually-spaced upstanding leg pieces. The leg pieces are joined at one end to the foot assembly, and are operatively joined at their opposite ends to an associated one of the arm members so as to align the foot assembly therebeneath.

In preferred embodiments, the extension members will comprise four equiangularly spaced, generally planar triangular members, each having opposite faces and one side edge along which it is attached to the circular member. The extension members are folded inwardly to lie substantially flat upon the circular member in their retracted positions, each presenting one of its faces upwardly to cooperatively provide the generally circular supporting surface of the skid. They are folded outwardly in the extended positions so as to dispose their opposite side faces upwardly and substantially in a common plane, thereby cooperatively providing the generally square supporting surface.

The extension members will most desirably be of right-triangular configuration, in which case the attached edge will constitute the hypotenuse of the figure and the location of hinged attachment will lie substantially along a chord of the circumference of the circular member. The skid will advantageously additionally include four generally planar, right-triangular web members attached to a ring-like circular member at equiangularly spaced positions and with their right-angular apices inwardly directed and disposed adjacent the geometric center, in which case the attached edge of each extension member will be disposed contiguous to the hypotenuse edge of one of the web members.

Normally, the skid will be so constructed as to define between the extension members, and entirely through the circular member, a plurality of passages dimensioned and configured to receive one of the leg members. The passages will be angularly offset from the leg members so as to adapt the skid for stacking with a like skid disposed upon it. The skid will normally also have circumferential edge structure adapted to permit rolling transport, and to facilitate such movement means may be provided for disengageably maintaining the extension members in retracted positions in the closed skid configuration.

The tubular pieces employed in the preferred leg member structure will be of circular cross section, with the two outwardly positioned pieces being of the same diameter and smaller than the centrally positioned piece. The up-standing leg pieces will normally be joined directly to the associated arm member, and will be oriented normal to parallel planes in which the arm members and foot assemblies lie.

DETAILED DESCRIPTION OF THE ILLUSTRATED EMBODIMENTS

Figure 1:
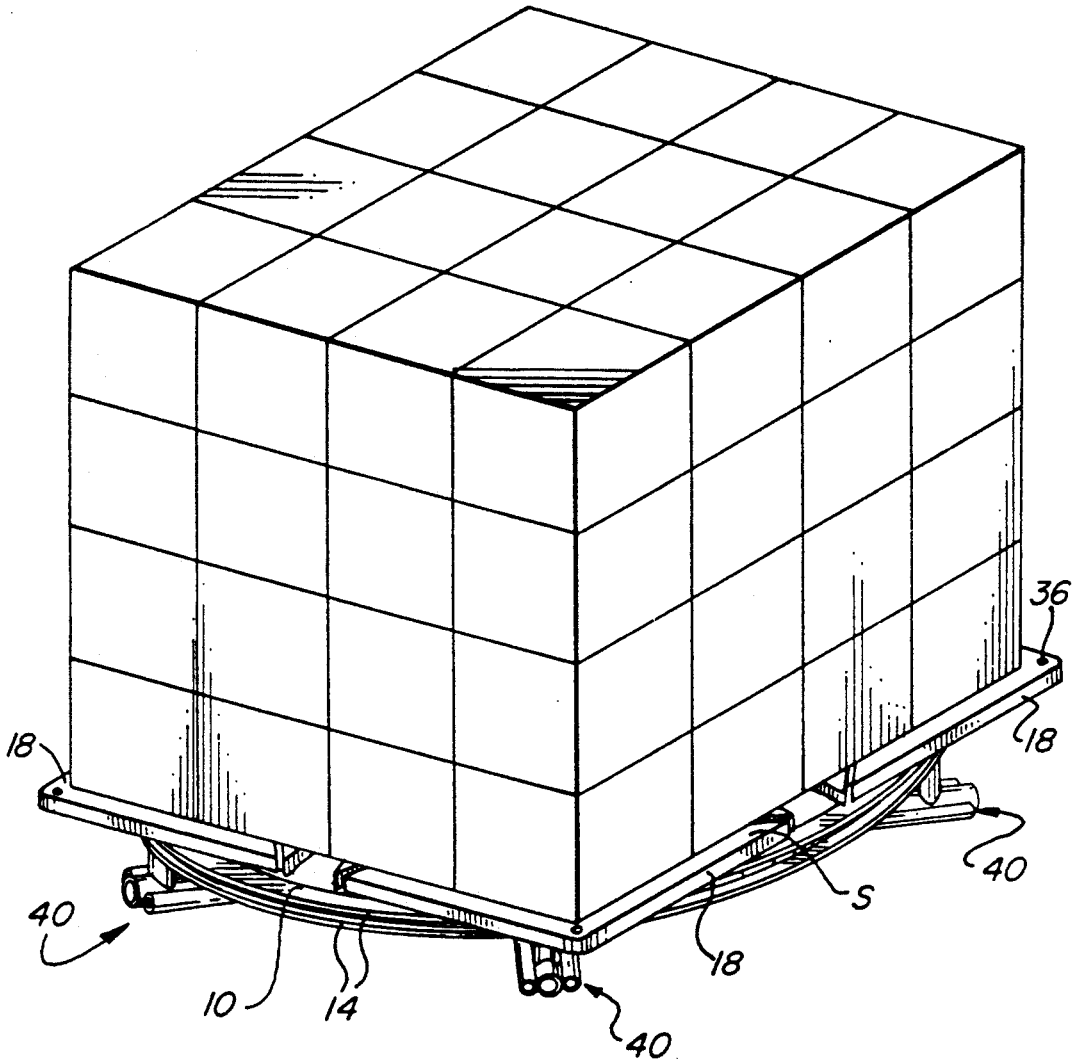
FIG. 1 is a perspective view of a skid embodying the present invention, shown in its open, square configuration for supporting a cubic load.

Turning now in detail to the appended drawings, therein illustrated is a skid embodying the invention, the foundation or substructure of which consists of a ring member 10 and four arm members 12, the latter extending radially from a common center at which they are joined to one another. The ring member 10 will advantageously be fabricated from steel channel stock, the flange portions 14 of which provide edges upon which the skid can roll in the manner described in the aforementioned patent; the arm members 12 are advantageously of box-steel construction welded to one another and to the member 10.

Four right-triangular panels or webs 16 are affixed upon the foundation with their apices inwardly directed and centrally disposed. They are equiangularly spaced and are so dimensioned as to substantially cover each of the four quadrants of the circle, while defining therebetween radial slots 22 which extend entirely through the structure and substantially bisect the angles between the adjacent arms 12.

Figure 2:
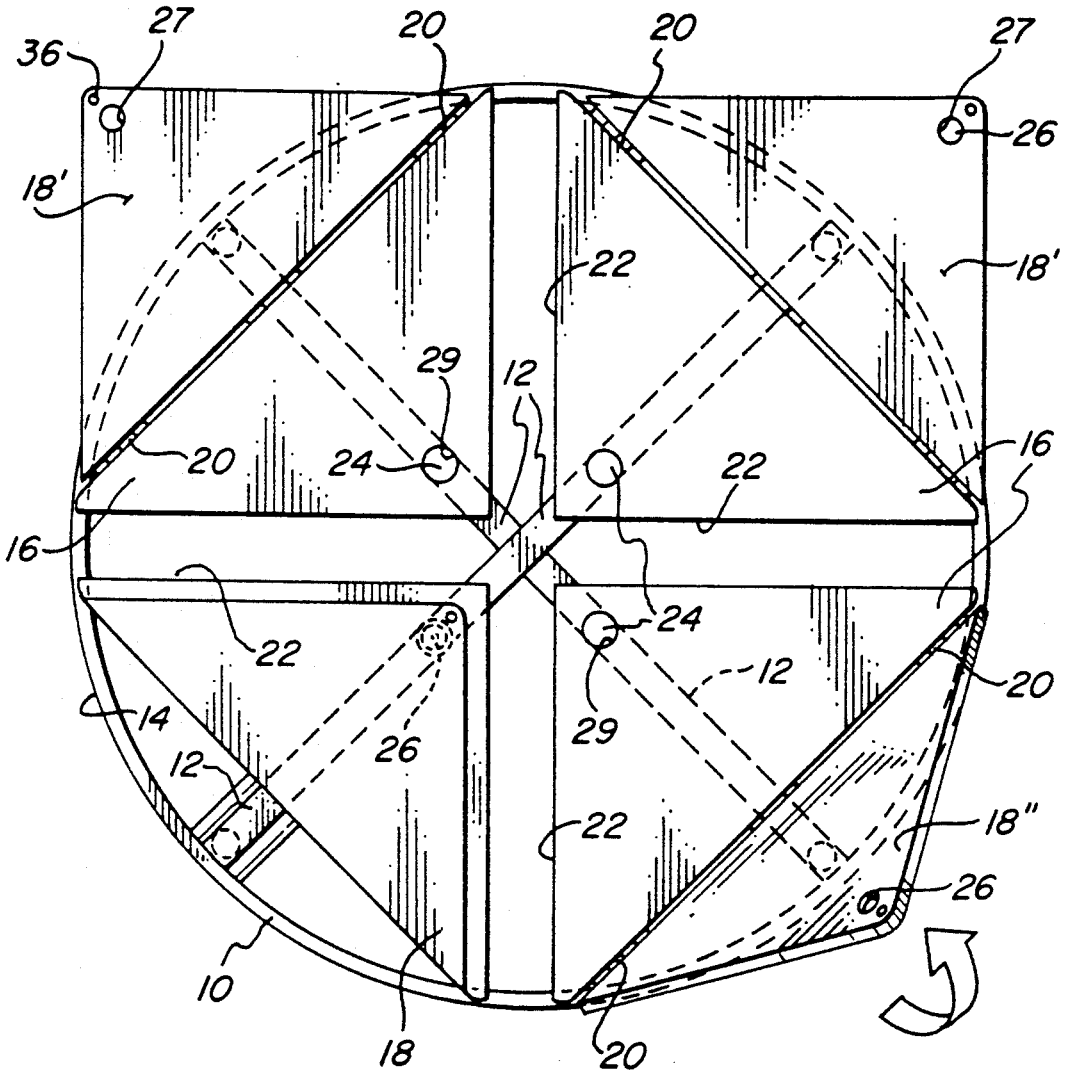
FIG. 2 is a plan view of the skid of FIG. 1, depicting the triangular extension members disposed in each of three different positions.
Figure 3:
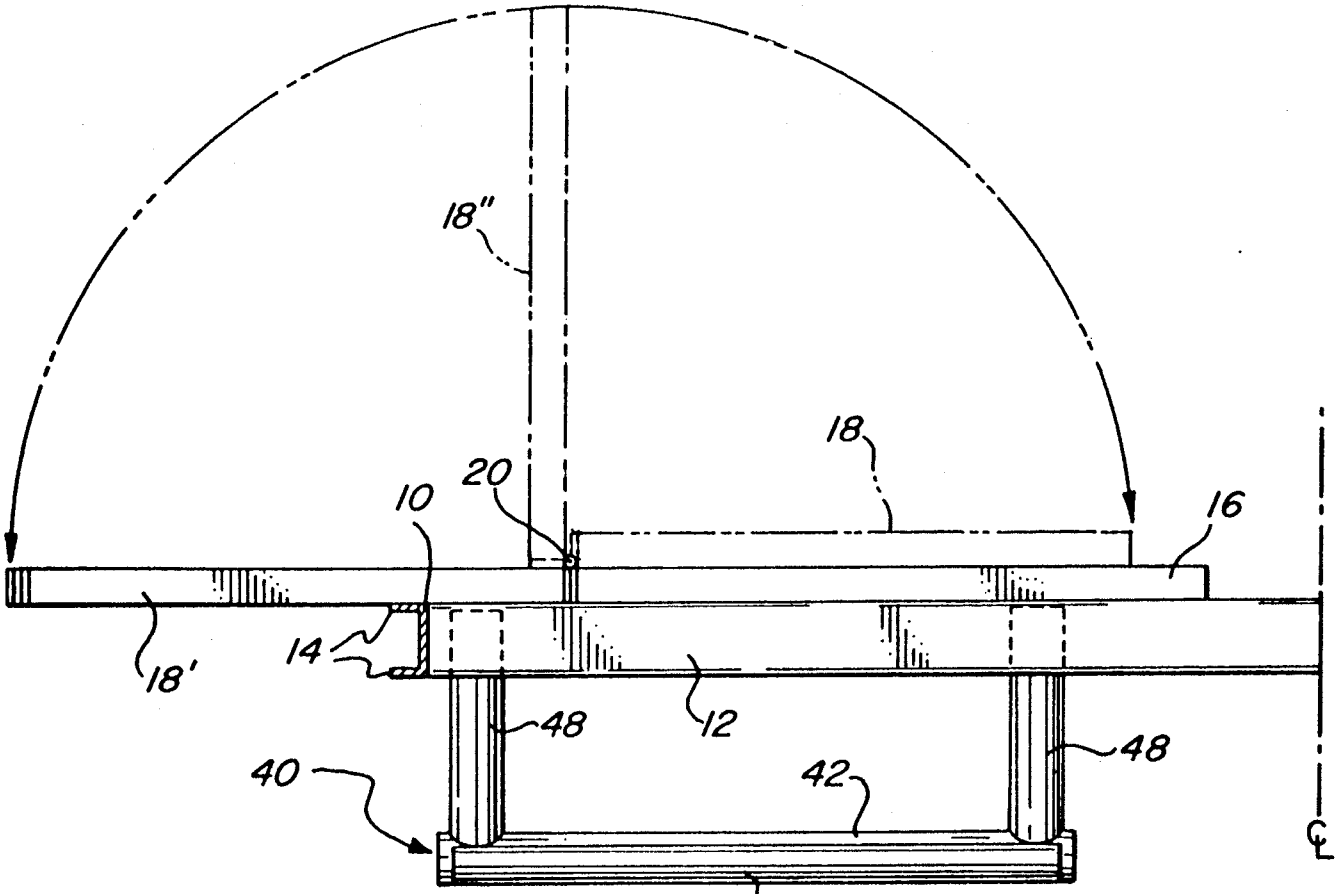
FIG. 3 is a fragmentary side elevational view of the skid of the previous Figures, drawn to an enlarged scale and showing (in full line) one of the extension members in its fully extended position, and also showing (in phantom line) the extension member in its fully retracted position and in a position intermediate therebetween.

A right-triangular extension member 18 is attached by hinges 20 to each of the panels 16 with their respective hypotenuse edges contiguous. As is best seen in FIG. 2, the extension members 18 can be disposed inwardly, to lie substantially flat upon their associated panels 16, and they can be pivoted to fully extended, open positions (as shown by the members 18'); member 18'' is at an intermediate position in the course of closure, as indicated by the arrow.

Figure 6:
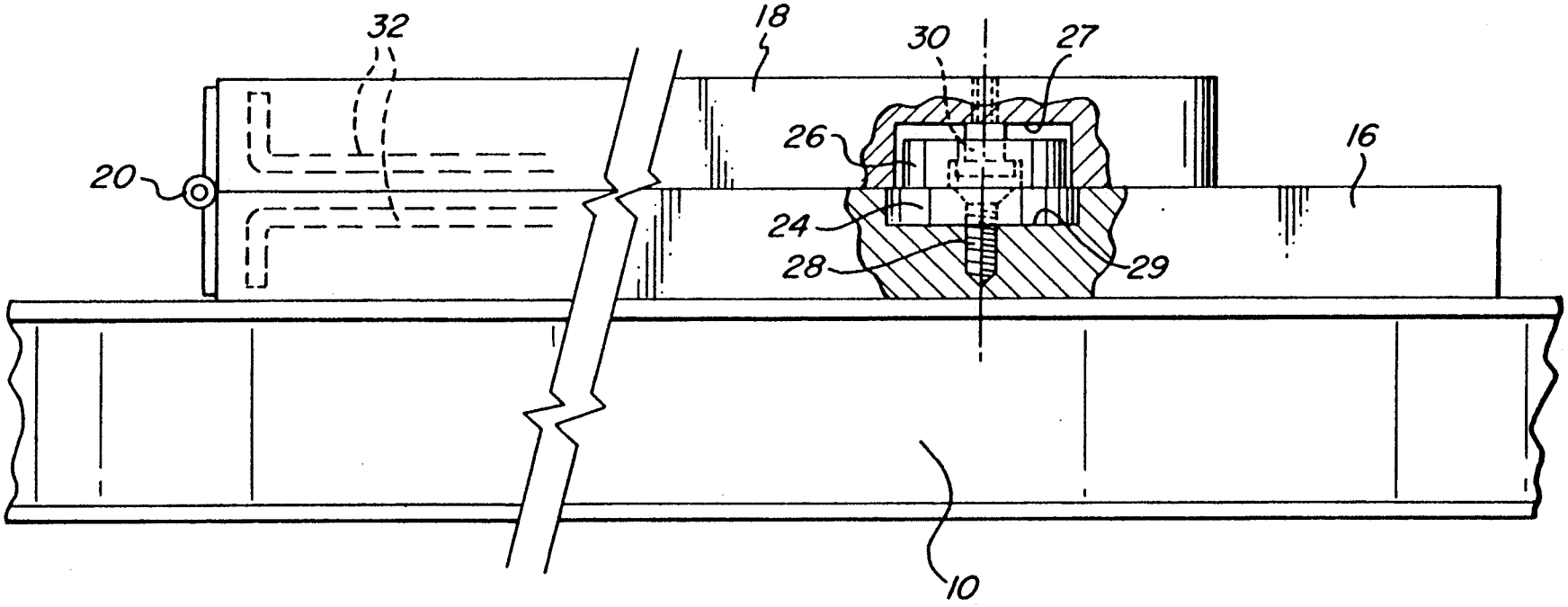
FIG. 6 is a fragmentary view, drawn to an enlarged scale, showing one of the extension members folded to its substantially flat position against an associated web member of which the skid is comprised, with sections broken away to expose elements used for maintaining the member in closed position.

It will be appreciated that the skid will present a circular profile, and a generally circular supporting surface, with all four of the extension members 18 folded inwardly. This will enable transport by rolling on edge, which is facilitated by the provision of disengageable fastening means. FIG. 6 shows this feature in greatest detail, depicting a generally annular magnet 26, seated in a circular socket 27 and held in place by machine screw 30, in engagement with a steel disk 24 seated in a registering recess 29 and held in place by wood screw 28. It will be noted that the screw 30 is sized to permit slight play of the magnet 26, so as to enable the magnet to come into full surface contact with the disk 24 and thereby exert its maximum holding force. FIG. 6 also suggests the presence of embedded reinforcing elements 32, advantageously used when the panels 16 and members 18 are of foamed core construction, as will be desirable in certain instances.

Figure 5:
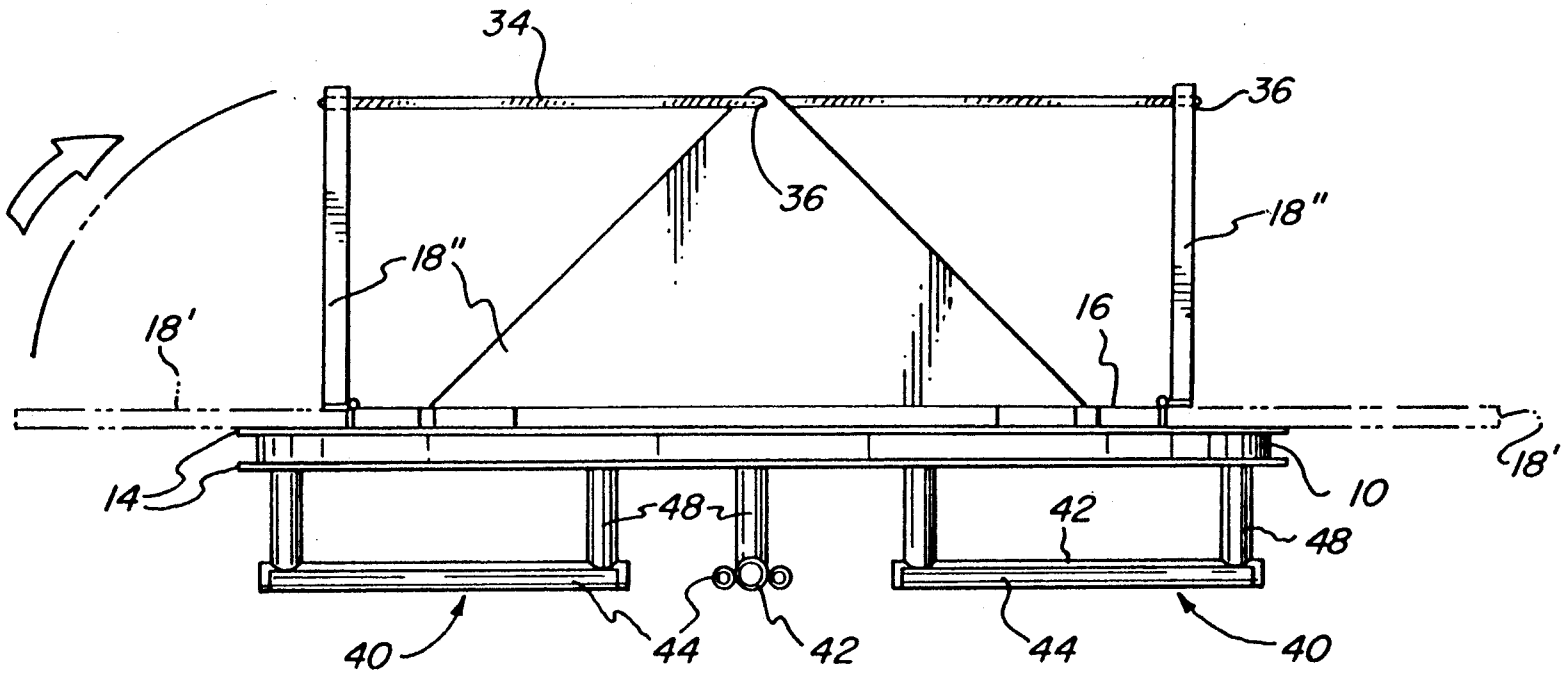
FIG. 5 is a side elevational view showing the skid with the extension members held in upright positions, also showing in phantom line the fully extended, flat positions of two of the members.

FIG. 5 shows the skid with the extension members 18 held in intermediate, upright position by a rope 34 or the like. The tips of the members 18 will be provided with small holes 36 or the like to accommodate such a manner of use, which may be advantageous for carrying otherwise unconstrained or miscellaneous items on the skid.

Figure 4:
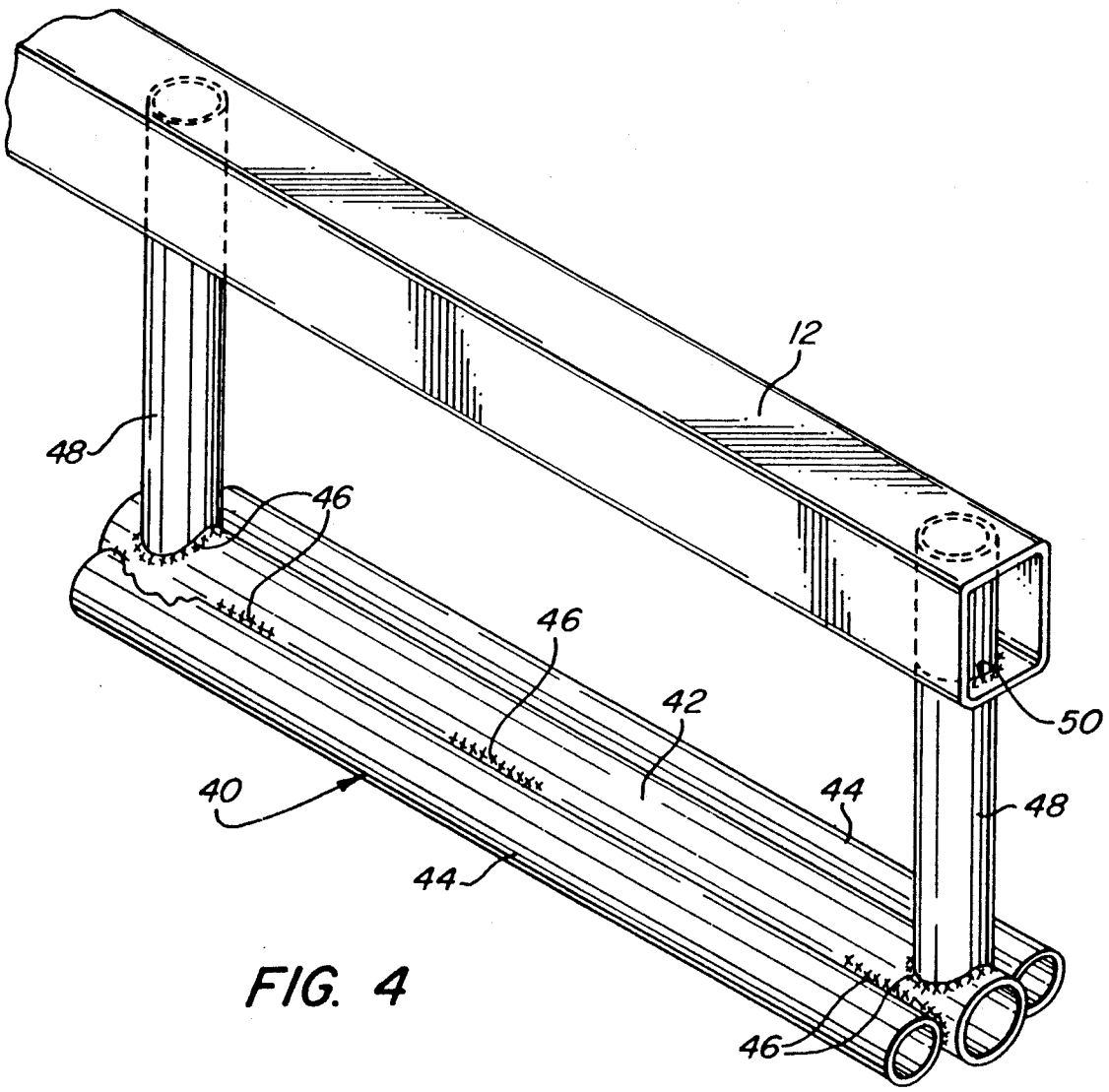
FIG. 4 is a fragmentary perspective view of one of the leg members utilized in the skid of the invention.

FIG. 4 best illustrates the leg member utilized in the skid of the invention. It includes a foot assembly, generally designated by the numeral 40, which consists of a relatively large diameter, central straight tubular piece 42, and two smaller diameter straight tubular pieces 44 affixed (as by weldments 46) along opposite sides of the piece 42. As can be seen, the tubular pieces 42, 44 extend parallel to one another and in substantially coplanar relationship.

Upright tubular pieces 48 are welded at the bottom to the central piece 42 adjacent its opposite ends, and at the top to the associated arm member 12 of the skid substructure. A circular hole 50 is formed through the lower side of the arm 12 to permit the upper end of the leg piece 48 to pass thereinto, for maximum strength and support. It will be appreciated that the arm 12 and the foot assembly 40 lie in parallel (normally horizontal) planes, to which both of the leg pieces 48 are perpendicular.

There are a number of advantages to the use of leg members having the structure described. Firstly, they serve to rigidify and strengthen the arms 12 to a very substantial extent, greatly enhancing the strength-to-weight ratio of the overall skid structure. Secondly, the relative width of the foot assembly averts any tendency that a narrower structure might have to lodge between adjacent rollers of a conventional conveyor; normally, there is a gap of about 2 to 2.5 inches (5.1 to 6.4 centimeters) between such rollers, which would be spanned by a foot structure fabricated from a nominal ¾-inch central pipe and two ½-inch outer pipes. An additional advantage resides in the ability of the foot structure to provide visual evidence that the skid has been overloaded or dropped, by virtue of the flattening distortion that would tend to occur in the normally circular cross section of the tubular pieces. And finally, the tubes may be utilized for the confined (and thereby protected) passage of a rope or other element used for securing a load to the skid.

Figure 7:
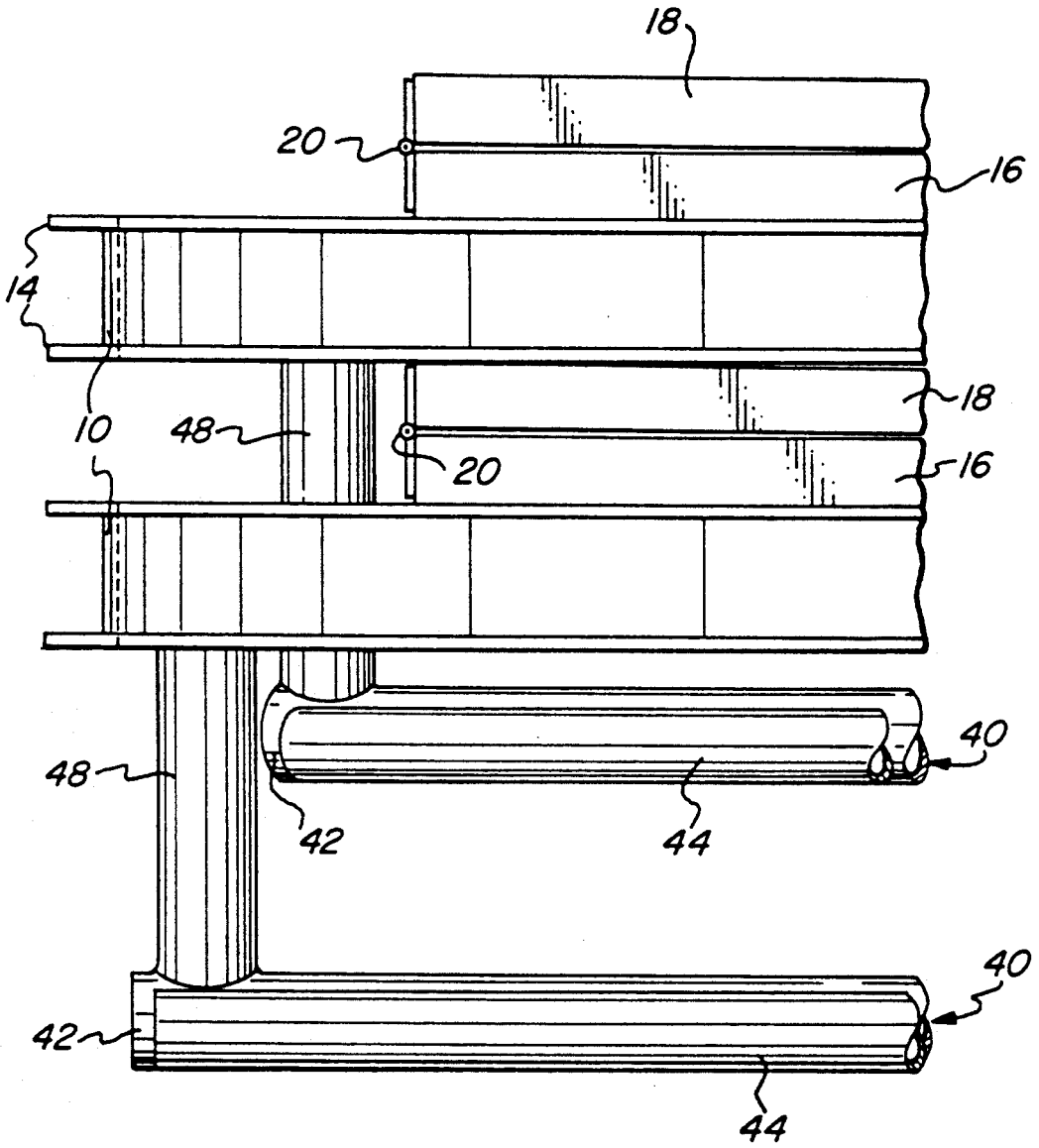
FIG. 7 is a fragmentary, side elevational view showing two skids embodying the invention stacked one upon the other.

FIG. 7 shows two stacked skids embodying the invention, which may be secured in assembly, if so desired, to facilitate rolling on their cooperating edge flanges. It will be appreciated that the skids are angularly offset from one another, with the leg structures of the overlying skid passing through the elongated spaces 22 of the underlying skid and extending between the leg structures thereof, as mentioned hereinabove. It will also be appreciated that the leg structures illustrated are ideally suited for use to receive the tines of a forklift or pallet truck; not only can approach be made from each of eight directions, but also the smaller diameter of the outboard pieces 42 will serve a ramp-like function, guiding the wheeled tines of a pallet truck over the foot assembly 40.

Although the best mode for carrying out the invention has been set forth, it will be appreciated that variations can be made without departure from the novel concepts hereof or the scope of the claims. For example, extension members that are non-triangularly shaped, and/or that are movable between extended and retracted positions by other than pivotal, hinging action, may be employed if so desired, as may supplemental means for supporting the panels in open position. The structure of the extension members, and of any panel members employed, may of course vary from the form described, as may be desirable to provide an optimal strength:weight ratio and/or to provide desired surface or other characteristics in the closed and opened configurations; to these ends, the members may comprise a frame-like structure, a mesh or expanded-metal overlay, wooden planking, laminated plastic construction, etc.

The skid foundation will normally be of welded metal construction, but components of plastic and/or wood may be substituted, as appropriate. And although the leg members illustrated are integrated with the radial arms of which the circular member is comprised, as will afford the advantageous strengthening desired without unduly increasing weight, a leg unit of frame-like construction may be utilized in which an overlying top piece extends between the tops of upright leg pieces, for fastening to a separate arm member. The number of radial arms (and indeed leg members) used may of course vary from the foregoing description, consistent with the attainment of the objects expressed herein.

Thus, it can be seen that the present invention provides a novel skid that is convertible to present alternatively generally circular and generally square supporting surfaces. The skid retains the capability for rolling transport and stacking that is exhibited by the unit of aforementioned U.S. Pat. No. 4,890,560 (and indeed, it can be stacked and rolled therewith), and it satisfies the other objects expressed therein. In addition, the novel leg members described contribute to the overall strength of the skid, as well as improving its adaptation for transport on a conventional roller conveyor and affording the further advantages set forth.

Having thus described the invention what is claimed is:

1. A convertible skid providing alternatively generally circular and generally square configurations, comprising:

a circular member including a multiplicity of elongate arm members extending generally radially toward the center of said circular member, said circular member having an upper portion and a circumferential edge structure that is disposed outermost on said skid in said generally circular configuration;

a plurality of leg members cooperating to support said skid on a flat surface; and a multiplicity of extension members attached to said upper portion of said circular member for movement between retracted and extended positions relative to said circular member, and providing in said retracted and extended positions, respectively, said generally circular configuration and said generally square configuration of said skid, said extension members lying substantially entirely within the boundary of said edge structure in said retracted positions thereof and cooperating to afford a substantially circular supporting surface on said skid in said generally circular configuration, and said extension members lying substantially outwardly of said boundary in said extended positions thereof and cooperating to afford an effectively square supporting surface on said skid in said generally square configuration; said leg members being operatively joined to said arm members and extending downwardly therefrom at spaced locations about said circular member, each of said leg members including an elongate foot assembly comprised of three tubular pieces laterally joined to one another in parallel and as a generally coplanar assemblage, and a pair of upstanding leg pieces having opposite ends, said leg pieces being joined at one end to said foot assembly at mutually spaced locations along said foot assembly, and said leg pieces being operatively joined at their opposite ends to an associated one of said arm members so as to align said foot assembly therebeneath.

2. A convertible skid providing alternatively generally circular and generally square configurations, comprising:

a circular member having an upper portion, and circumferential edge structure disposed outermost on said skid in said generally circular configuration;

a plurality of leg members extending downwardly from said circular member at spaced locations thereabout, said leg members cooperating to support said skid on a flat surface; and a multiplicity of extension members attached to said upper portion of said circular member for movement between retracted and extended positions relative to said circular member, and providing in said retracted and extended positions, respectively, said generally circular configuration and said generally square configuration of said skid, said extension members lying substantially entirely within the boundary of said edge structure in said retracted positions thereof and cooperating to afford a substantially circular supporting surface on said skid in said generally circular configuration, and said extension members lying substantially outwardly of said boundary in said extended positions thereof and cooperating to afford an effectively square supporting surface on said skid in said generally square configuration thereof.

3. The skid of claim 2 wherein said extension members comprise four equiangularly spaced, generally planar triangular members, each of said triangular members having two opposite faces and having one side edge along which it is attached to said upper portion, said triangular members being folded inwardly and lying substantially flat upon said circular member in said retracted positions, with each presenting one of said opposite faces thereof to cooperatively provide said generally circular supporting surface, and said triangular members being folded outwardly in said extended positions to dispose the other of said opposite faces thereof substantially in a common plane so as to cooperatively provide a generally square supporting surface on said skid.

4. The skid of claim 3 wherein said extension members are of right-triangular configuration, wherein said one side edge constitutes the hypotenuse of said configuration, and wherein a hinged attachment lies substantially along a chord of the circumference of said circular member.

5. The skid of claim 4 wherein said circular member comprises a ring member and said upper portion thereof includes four generally planar, right-triangular web members attached to said ring member at equiangularly spaced positions and with their right-angular apices inwardly directed and disposed adjacent the geometric center of said circular member, said one side edge of each of said extension members being disposed contiguously to, and substantially coextensively with, the hypotenuse edge of an associated one of said web members.

6. The skid of claim 2 additionally including means for maintaining said extension members in said retracted positions thereof.

7. The skid of claim 2 wherein a plurality of passages, each passage dimensioned and configured to receive therethrough one of said leg members, are defined between adjacent extension members and entirely through said circular member, said passages being angularly offset from said leg members to adapt said skid for stacking, as an underlying skid, with a like skid, the leg members of the like skid so stacked being received through said passages of said underlying skid.

8. The skid of claim 2 wherein said circumferential edge structure of said circular member is adapted for rolling of said skid thereon.

9. The skid of claim 8 wherein said circular member is a ring member, and wherein said skid additionally includes a multiplicity of elongate arm members extending radially with respect to the geometric center of said ring member, said arm members having inner and outer ends and being effectively joined to one another and to said ring member at said inner and outer ends, respectively.

10. A skid, comprising: a support having a center and an upper portion providing a supporting surface, said support including a multiplicity of elongate arm members extending generally radially with reference to said center; and a plurality of leg members operatively joined to said arm members and extending downwardly therefrom, at spaced locations about said support, for cooperative support of said skid on a flat surface; each of said leg members including an elongate foot assembly comprised of three tubular pieces laterally joined to one another in parallel and as a generally coplanar assemblage, and a pair of upstanding leg pieces having opposite ends, said leg pieces being joined at one end to said foot assembly at mutually spaced locations along said foot assembly, and said leg pieces being operatively joined at their opposite ends to an associated one of said arm members so as to align said foot assembly therebeneath.

11. The skid of claim 10 wherein said tubular pieces are of circular cross section, and wherein the diameters of the two pieces positioned outwardly in said foot assembly are generally equal and smaller than that of the centrally positioned piece.

12. The skid of claim 10 wherein said leg pieces are joined directly to said associated arm members, and wherein said arm members and foot assemblies lie in parallel planes to which said leg pieces are normal.

* * * * *